US009719231B2

(12) United States Patent
White

(10) Patent No.: US 9,719,231 B2
(45) Date of Patent: Aug. 1, 2017

(54) IMPLEMENT SYSTEM FOR MACHINE

(71) Applicant: Caterpillar Inc., Peoria, IL (US)

(72) Inventor: James White, Loughborough (GB)

(73) Assignee: Caterpillar Inc., Peoria, IL (US)

( * ) Notice: Subject to any disclaimer, the term of this patent is extended or adjusted under 35 U.S.C. 154(b) by 23 days.

(21) Appl. No.: 14/707,280

(22) Filed: May 8, 2015

(65) Prior Publication Data

US 2015/0337519 A1 Nov. 26, 2015

(30) Foreign Application Priority Data

May 20, 2014 (GB) ..... 1408893.4

(51) Int. Cl.
*E02F 3/96* (2006.01)
*E02F 3/36* (2006.01)

(52) U.S. Cl.
CPC ..... *E02F 3/962* (2013.01); *E02F 3/3609* (2013.01); *E02F 3/96* (2013.01); *E02F 3/964* (2013.01); *Y10T 29/49819* (2015.01); *Y10T 29/49821* (2015.01)

(58) Field of Classification Search
CPC ..... E02F 3/96; E02F 3/3627; E02F 3/33636; Y10T 403/7033
USPC ..... 37/403, 405, 406, 410; 414/723, 724, 414/912
See application file for complete search history.

(56) References Cited

U.S. PATENT DOCUMENTS 5,564,885 A 10/1996 Staben, Jr.
6,287,070 B1 9/2001 Perry
6,408,550 B1 * 6/2002 Allsopp ..... B66F 9/065 37/405
2005/0129494 A1 6/2005 Chandler et al.
2006/0245898 A1 * 11/2006 Diaz ..... E02F 3/3627 414/686
2011/0020061 A1 1/2011 Vering et al.
2013/0028696 A1 * 1/2013 Peschel ..... B66F 9/142 414/705

FOREIGN PATENT DOCUMENTS

EP 1065320 A1 1/2001
GB 2343171 A 5/2000

OTHER PUBLICATIONS

United Kingdom Intellectual Property Office, Search Report in United Kingdom Patent Application No. GB1408893.4, Nov. 17, 2014, 1 p.

* cited by examiner

*Primary Examiner* — Gerald McClain
*Assistant Examiner* — Ronald Jarrett

(57) ABSTRACT

An implement system is adapted for use with a machine including an implement and a fork assembly. The fork assembly having one or more loading members includes a first upright portion, a second upright portion, and a crimped portion. Further, the crimped portion interconnects the first upright portion and the second upright portion. A mounting device is configured to support the implement and the fork assembly. Further, the mounting device includes a first side plate and a second side plate. A first transverse member is disposed between the first side plate and the second side plate. A second transverse member is disposed between the first side plate and the second side plate, such that the one or more loading members of the fork assembly are pivotally connected to the second transverse member.

5 Claims, 4 Drawing Sheets

IMPLEMENT SYSTEM FOR MACHINE

CROSS-REFERENCE TO RELATED APPLICATIONS

This patent application claims the benefit of United Kingdom Patent Application No. 1408893.4, filed May 20, 2014, which is incorporated by reference.

TECHNICAL FIELD

The present disclosure generally relates to an implement system for a machine, and more particularly to a mounting device for an implement and a fork assembly in the implement system.

BACKGROUND

A material handling machine, such as a backhoe loader, includes a frame provided with a ground engaging members and a power source. The machine includes a backhoe structure and a front loading structure. The front loading structure or the second loading structure may include an implement system with a first implement and/or a second implement. Examples of such implements include, but are not limited to, buckets and forks. Further, the first implement and the second implement may be connected via mounting devices to the front loading structure or the backhoe structure.

U.S. Pat. No. 6,408,550 discloses one system including an arm, and a working implement mounting device provided at an end of the arm. A loader bucket and a fork assembly are mounted on the working implement mounting device. Further, the fork assembly is movable relative to the working implement mounting device between a first position and a second position. In the first position, the fork assembly is in an operative position, while the loader bucket is de-mounted from the arm. In the second position, the fork assembly is in a stowed position, to allow use of the loading bucket mounted on the arm. The fork assembly pivots from a top portion of the work implement mounting device. Further, the fork assembly may need to be man-handled for movement into the first position and the second position.

SUMMARY

In an aspect, the present disclosure describes an implement system including an implement and a fork assembly. The fork assembly having one or more loading members includes a first upright portion, a second upright portion, and a crimped portion. Further, the crimped portion interconnects the first upright portion and the second upright portion. A mounting device is configured to support the implement and the fork assembly. Further, the mounting device includes a first side plate and a second side plate. A first transverse member is disposed between the first side plate and the second side plate. A second transverse member is disposed between the first side plate and the second side plate, such that the one or more loading members of the fork assembly are pivotally connected to the second transverse member.

In an aspect of the present disclosure, de-mounting the implement from the mounting device. Further, tilting the mounting device and the fork assembly from a first position to a second position. Furthermore, unlocking the loading member of the fork assembly from the mounting device and tilting the mounting device back to the first position from the second position.

Other features and aspects of this disclosure will be apparent from the following description and the accompanying drawings.

DETAILED DESCRIPTION

Figure 1:
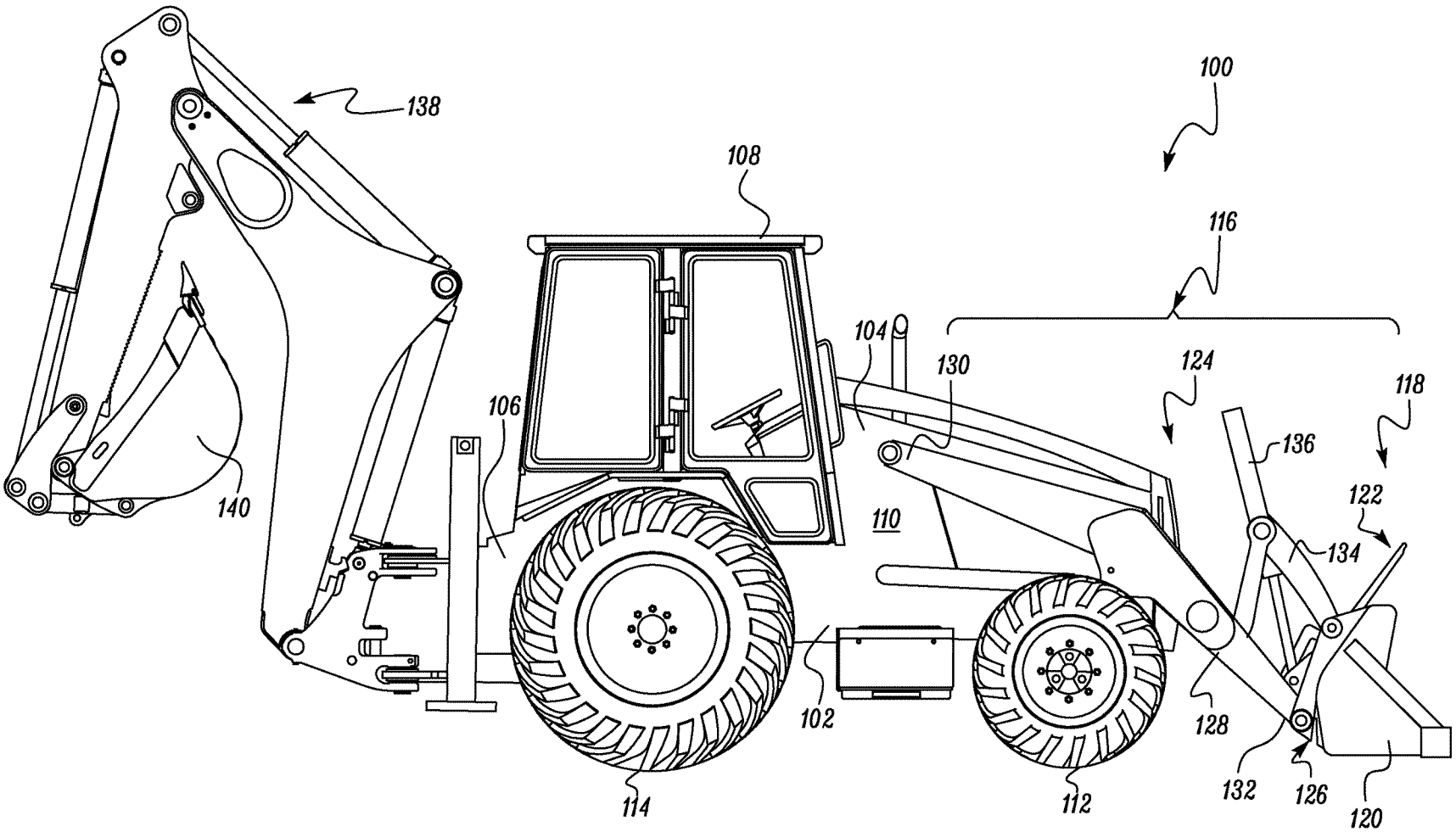
FIG. 1 is a side view of a machine having an implement system, in accordance with an aspect of the present disclosure.

FIG. 1 illustrates a side view of a machine 100, such as a backhoe loader, in which various embodiments of the present disclosure may be implemented. In an exemplary embodiment, as illustrated in FIG. 1, the machine 100 includes a frame 102. The frame 102 may include a front section 104 and a rear section 106. The frame 102 of the machine 100 may support an operator cab 108 and an engine enclosure 110. As well known in the art, an engine (not shown) may be housed within the engine enclosure 110. The engine is used to provide power to a final drive assembly, via a mechanical or an electrical transmission. The operator cab 108 may include one or more control means to control the operations of the machine 100. The machine 100 may be supported by ground engaging members, such as a pair of front wheels 112 (only one side is shown) mounted on the front section 104 and a pair of rear wheels 114 (only one side is shown) mounted on the rear section 106. Alternatively, the machine 100 may include a conventionally known tracks or crawlers as the ground engaging members.

A front loading structure 116 may be connected to the front section 104 of the frame 102. In an embodiment of the present disclosure, the front loading structure 116 may include an implement system 118. The implement system 118 may further include an implement 120 and a fork assembly 122. As illustrated, the implement 120 may be a loader bucket. However, in various other embodiments of the present disclosure, the implement 120 may be at least one of a blade, a grapple, a hammer, or any other type of work implement. The implement system 118 may further include a mounting device 126 to support the implement 120 and the fork assembly 122. Further, the mounting device 126 may be connected to a linkage assembly 124 mounted on the front section 104. The linkage assembly 124 may include a pair of lift arms 128 (only one side shown) pivotally mounted to the front section 104 at a first end 130. Further, the mounting device 126 is pivotally mounted at a second end 132 of the lift arm 128. Still, the linkage assembly 124 may also include a pair of tilt arms 134 and tilt actuators 136 (only side shown), connected to the mounting device 126. In an aspect of the present disclosure, the mounting device 126 may be configured to interconnect the lift arms 128, the tilt arms 134 and the tilt actuators 136 with the implement 120 and/or the fork assembly 122.

The machine 100 may also include a backhoe assembly 138 connected to the rear section 106 of the frame 102. The backhoe assembly 138 may include a backhoe implement 140. It will be apparent to a person having ordinary skill in the art that in various other embodiments, backhoe assembly 138 may alternatively include at least one of a blade, a grapple, a hammer, or any other type of implement. The front loading structure 116 and the backhoe assembly 138 may be hydraulically or electrically controlled with the control means provided in the operator cab 108.

Figure 2:
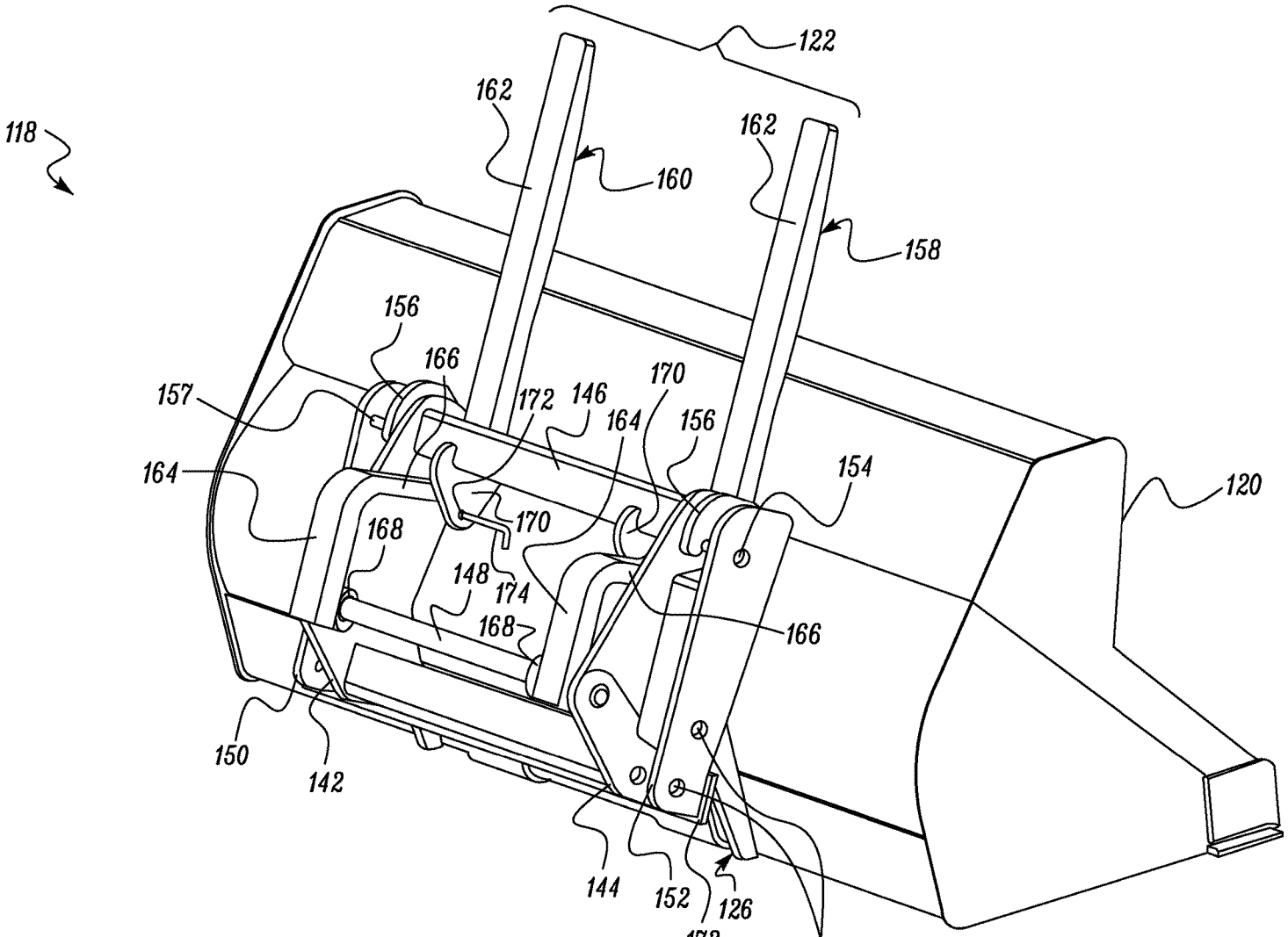
FIG. 2 is a perspective view of the implement system with an implement and a fork assembly coupled to a mounting device.

FIG. 2 illustrates a perspective view of the implement system 118 with the implement 120 and the fork assembly 122 coupled to the mounting device 126. In an embodiment of the present disclosure, the mounting device 126 may include a first side plate 142 and a second side plate 144. The first side plate 142 and the second side plate 144 may be fixed relative to each other at a predetermined distance based on the size and shape of the implement system 118. The first side plate 142 and the second side plate 144 may be interconnected by a first transverse member 146. In the illustrated embodiment, the first transverse member 146 may be disposed substantially between top portions of the first side plate 142 and the second side plate 144. A second transverse member 148 may be disposed substantially between central portions of the first side plate 142 and the second side plate 144. Further, a first parallel plate 150 and a second parallel plate 152 may be arranged at a distance from the first side plate 142 and the second side plate 144, respectively. Further, the first set of plates 142, 150, and the second set of plates 144, 152, may have aligned openings 154, configured to receive the lift arms 128, the tilt arms 134 and the tilt actuators 136, as known in the art.

Referring to FIG. 2, the implement 120 may be provided with at least one hook 156 on a rear surface. In the illustrated embodiment, the hook 156 holds the implement 120 by locking into a transverse pin 157 provided between the first set of plates 142, 150. Further another hook 156 may also be provided to hold the implement 120 by locking into another transverse pin 157 provided between the second set of plates 144, 152. As illustrated in FIGS. 1 and 2, the fork assembly 122 may be configured to be attached with the second transverse member 148 in a first position. The fork assembly 122 may include a pair of loading members or forks 158, 160. The loading members 158, 160 may be pivotably connected on the second transverse member 148 such that the loading members 158, 160 may pivot about the second transverse member 148 to a second position. Further, the mounting device 126 may include a stop member 173 extending between the first set of plates 142, 150 and the second set of plates 144, 152. The stop member 173 is configured to restrict the loading members 158, 160 at the second position.

According to an aspect of the present disclosure, each of the loading members 158, 160 of the fork assembly 122 may include a first upright portion 162 and a second upright portion 164 interconnected by a crimped portion 166. Further, the second upright portion 164 may include a sleeve member 168 configured to be slidably received on the second transverse member 148. Further, the sleeve member 168 on the second upright portion 164 may slidably adjust the loading members 158, 160 on the second transverse member 148 for receiving work pieces of different sizes, in an operative state.

In an aspect of the present disclosure, at least one locking plate 170 may be disposed on the first transverse member 146. Further, the locking plate 170 may include an opening 172, to enable a locking element 174 to be inserted into the opening 172. The locking element 174 may be a mounting pin that locks the fork assembly 122 in the first position. Those skilled in the art will recognize that alternative locking element embodiments may also be employed. The locking element 174 may hold the crimped portion 166 of the loading members 158, 160 beside the first transverse member 146.

In an aspect of the present disclosure, the mounting device 126 is of the so called "quick hitch or quick coupler" type whereby the implement 120 may readily be mounted and de-mounted therefrom. It will be appreciated that the loading members 158, 160 may only be in the first position and the second position, as illustrated in FIGS. Further, if the implement 120 is first de-mounted from the mounting device 126. The fork assembly 122 may be tilted down to the second position. The implement 120 may be mounted on the mounting device 126 in the working state, with the fork assembly 122 in the first position, as illustrated in FIG. 2.

Figure 3:
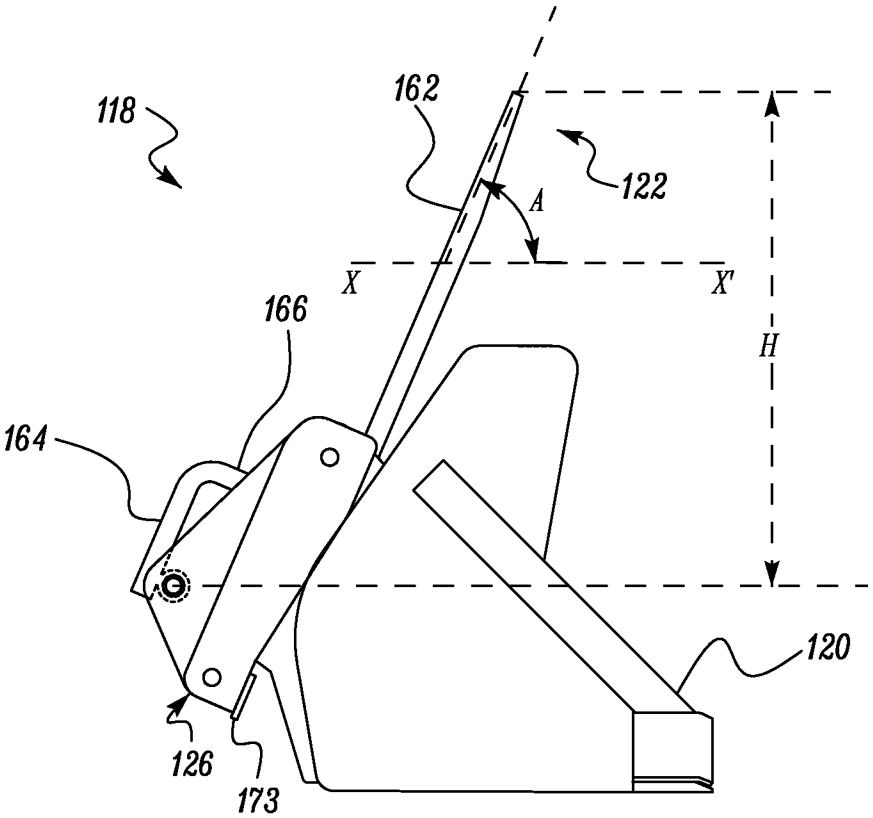
FIG. 3 is a side view of the implement system of FIG. 2 including the implement and the fork assembly supported on the mounting device.

FIG. 3 illustrates a side view of the implement system 118 with the fork assembly 122 in the first position. As illustrated, the first upright portion 162 of each of the loading members 158, 160 of the fork assembly 122 may be at an angle A with a horizontal axis X-X'. In an embodiment, the angle A may be less than a normal.

INDUSTRIAL APPLICABILITY

The industrial applicability of the implement system including an implement and a fork assembly associated with a mounting device described herein will be readily appreciated from the foregoing discussion. Although, the machine 100 is embodied as the backhoe loader, those skilled in the art will understand that the present disclosure may be applicable to other types of machines, for example, a compact track loader, a multiple terrain loader, a compactor, a front shovel, a harvester, a hydraulic excavators, a hydraulic mining shovel, an industrial loader, a skid steer loader, a track loader, a track-type tractor, a wheel dozer, a wheel excavator, a wheel loader or any other type of material handling machines having an implement system.

As illustrated in FIGS. 2 and 3, in an aspect of the present disclosure, the crimped portion 166 of the loading members 158, 160 of the fork assembly 122 may aid in an effective storage position between the mounting device 126 and the implement 120. Further, as the angle A between the first upright portion 162 and the horizontal axis XX' is less than normal may reduce an effective storage height H (see FIG. 3) of the loading member 158, 160 in the first position. The reduced effective storage height H may allow an operator to have a clear view of the implement 120 in the operative position.

Figure 5:
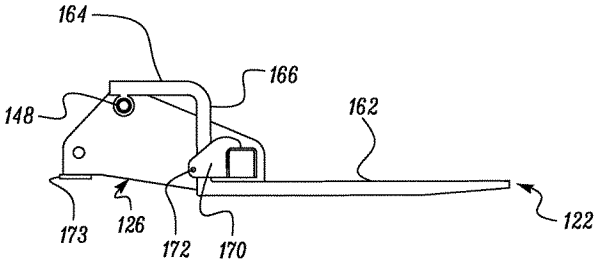
FIG. 5 is a side view of the mounting device with the fork assembly in the second position.
Figure 6:
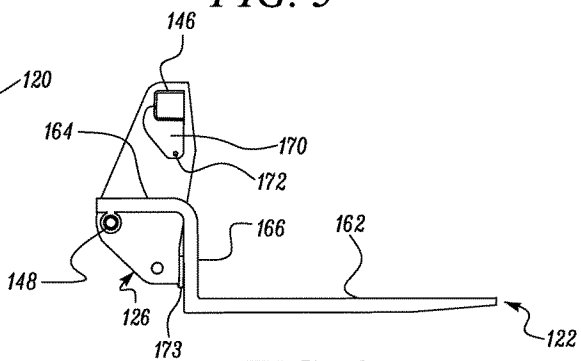
FIG. 6 is a side view of the mounting device in the first position and the fork assembly in the second position.
Figure 4:
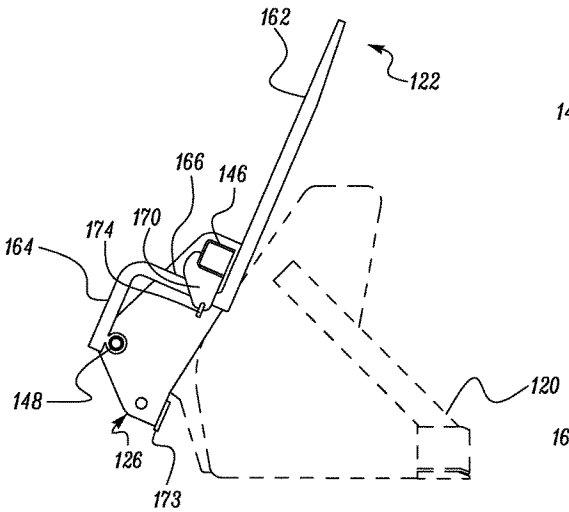
FIG. 4 is a side view of a mounting device with a fork assembly in a first position.

FIGS. 4 to 6 illustrates a sequence of an exemplary method for interchanging the implement 120 and the fork assembly 122 attached with the mounting device 126. The operator may de-mount the implement 120 from the mounting device 126 by unhooking the hook 156. As shown in FIG. 4, the loading members 158, 160 of the fork assembly 122 may be locked by the locking element 174 received in the opening 172 provided on the locking plate 170 in the first position. Further, the mounting device 126 and the fork assembly 122 may be tilted from the first position to the second position, as illustrated in FIG. 5. Furthermore, the locking element 174 may be removed from the opening 172 to unlock the loading members 158, 160 of the fork assembly 122 from the mounting device 126. The loading members 158, 160 may be rotated to rest against the stop member 173. Finally, the mounting device 126 may be tilted back to the first position from the second position, as illustrated in FIG. 6.

In accordance with an aspect of the present disclosure, on completion of work by the loading members 158, 160 of the fork assembly 122, the operator tilts the mounting device 126 from the first position to the second position. Further, the operator locks the loader members 158, 160 of the fork assembly 122 to the mounting device 126 and tilts the mounting device 126 and the fork assembly 122 to the first position. The operator may need to insert or remove the locking element 174 provided in the opening 172 of the locking plate 170. Further, the movement of the fork assembly 122 with the mounting device 126 may be controlled hydraulically from the operator cab 108. Therefore, the fork assembly 122 may be pivoted with respect to the second transverse member 148 from the first position to the second position and vice versa without using man power for the movement of the loading members 158, 160. In an aspect of the present disclosure, the sliding movement of the loading members 158, 160 may be hydraulically controlled from the operator cab 108 to suit various articles of different sizes.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An implement system for a machine comprising:

an implement having at least one hook;

a fork assembly having at least one loading member, each of the at least one loading member including:

a first upright portion, a second upright portion, and a crimped portion interconnecting the first upright portion and the second upright portion, wherein each of the at least one loading member of the fork assembly, when in a first position, has a storage angle defined between the first upright portion and a horizontal axis, the storage angle being an acute angle; and a mounting device, wherein the implement and the fork assembly are configured to be attached to the mounting device, the mounting device including:

a first side plate and a second side plate, a first transverse member disposed between respective top portions of the first side plate and the second side plate, a second transverse member disposed between respective central portions of the first side plate and the second side plate, wherein the at least one loading member of the fork assembly is pivotally connected to the second transverse member, and a transverse pin mounted to one of the first side plate and the second side plate, wherein the at least one hook of the implement is locked on the transverse pin, and wherein the mounting device includes a locking plate with an opening disposed on the first transverse member, such that the opening is configured to receive a locking element, the locking element locking the fork assembly in the first position, and the locking element holds the crimped portion of the at least one loading member beside the first transverse member.

2. The implement system of claim 1, wherein the implement is a loader bucket.

3. The implement system of claim 1, wherein the at least one loading member of the fork assembly is slidable on the second transverse member.

4. The implement system of claim 1, wherein the second upright portion of the at least one loading member includes a sleeve member, such that the sleeve member is configured to be slidably received on the second transverse member.

5. The implement system of claim 1, further comprising a stop member extending between the first side plate and the second side plate, the stop member configured to restrict rotation of the at least one loading member.

* * * * *